US006672698B1

(12) United States Patent
Sugiyama

(10) Patent No.: US 6,672,698 B1
(45) Date of Patent: Jan. 6, 2004

(54) INK JET RECORDING APPARATUS AND INK DETECTION METHOD IN PERTINENT APPARATUS

(75) Inventor: Shigeyuki Sugiyama, Hiratsuka (JP)

(73) Assignee: Canon Kabushiki Kaisha, Tokyo (JP)

( * ) Notice: Subject to any disclaimer, the term of this patent is extended or adjusted under 35 U.S.C. 154(b) by 112 days.

(21) Appl. No.: 09/640,587

(22) Filed: Aug. 18, 2000

(30) Foreign Application Priority Data

Aug. 25, 1999 (JP) ..... 11-238582
Aug. 8, 2000 (JP) ..... 2000-240239

(51) Int. Cl.[7] ..... B41J 29/393
(52) U.S. Cl. ..... 347/19
(58) Field of Search ..... 347/19, 14, 10, 347/12, 7, 23, 24, 5, 11, 43, 17, 6; 399/27, 24; 73/304; 358/504

(56) References Cited

U.S. PATENT DOCUMENTS

| | | | | |
|---|---|---|---|---|
| 4,313,124 A | | 1/1982 | Hara | 346/140 |
| 4,345,262 A | | 8/1982 | Shirato et al. | 346/140 |
| 4,459,600 A | | 7/1984 | Sato et al. | 346/140 |
| 4,463,359 A | | 7/1984 | Ayata et al. | 346/1.1 |
| 4,558,333 A | | 12/1985 | Sugitani et al. | 346/140 |
| 4,723,129 A | | 2/1988 | Endo et al. | 346/1.1 |
| 4,740,796 A | | 4/1988 | Endo et al. | 346/1.1 |
| 5,132,711 A | * | 7/1992 | Shinada et al. | 347/19 |
| 5,146,236 A | * | 9/1992 | Hirata et al. | 347/19 |
| 5,508,722 A | | 4/1996 | Saito et al. | 347/17 |
| 6,048,046 A | | 4/2000 | Saito et al. | 347/19 |
| 6,056,386 A | | 5/2000 | Nohata et al. | 347/19 |
| 6,086,179 A | * | 7/2000 | Kishi | 347/7 |

FOREIGN PATENT DOCUMENTS

| | | |
|---|---|---|
| JP | 59-123670 | 7/1984 |
| JP | 59-138461 | 8/1984 |

* cited by examiner

*Primary Examiner*—Stephen D. Meier
*Assistant Examiner*—Charles W. Stewart, Jr.
(74) *Attorney, Agent, or Firm*—Fitzpatrick, Cella, Harper & Scinto

(57) ABSTRACT

In the configuration in which ink is normally ejected from an ink head from which the ink is ejected, the reliability of a decision result is improved for each of a plurality of different inks.

A detection unit which outputs a detection signal by detecting the ink ejected from the ink jet head is used to perform detection by ejecting the ink in the vicinity including a detection position moving the ink jet head and the presence of ink ejection is decided by controlling the ink jet head so that at least one of the conditions such as an ejection start position, an ejection cycle of the ink, a travel speed of the ink jet head and the number of ejection times of the ink can be changed in accordance with light shielding characteristics of the ink ejected.

21 Claims, 10 Drawing Sheets

INK JET RECORDING APPARATUS AND INK DETECTION METHOD IN PERTINENT APPARATUS

BACKGROUND OF THE INVENTION

1. Field of the Invention

The present invention relates to an ink jet recording apparatus which relatively moves a carriage on which an ink jet head is mounted to a recording medium and performs recording and an ink detection method in the pertinent apparatus.

2. Related Background Art

Various recording apparatuses which perform recording on recording media such as paper and sheets for an OHP (overhead projector) are proposed up to this date. Among them, an ink jet recording apparatus directly injects ink from a recording head to recording paper, and is used as a recording apparatus which has advantages of low running costs and quiet recording operation.

In an ink jet recording apparatus, various methods which detect the presence of ink of an ink tank (ink cartridge) installed in an ink jet head are proposed. For example, there is a method of using a photo-interrupter equipped with a light emitting element and a light reception element to eject an ink droplet between the light emitting element and light reception element of the photo-interrupter, detecting whether an optical axis between the light emitting element and light reception element was intercepted or not based on the output of the photo-interrupter, and judging whether the ink was normally ejected or not, otherwise the presence of the ink.

On the other hand, in order to detect whether ink was normally ejected or not, otherwise the presence of the ink, there is also a method of judging the presence of remaining ink amount according to whether a mark for detecting the presence of the ink is printed on a recording medium and its detection mark is appropriately printed by a reflection-type photosensor.

However, among the conventional methods, the former method ejects ink between photosensors. In that case, if the configuration is used in which the ink is ejected by once moving an ink jet head between the photosensors and stopping it there, there is a problem that accurate detection cannot be performed when the ink cannot be ejected on the optical axis of a photo-interrupter with good accuracy. In particular, along with an improvement of the resolution of an ink jet recording apparatus in recent years, the liquid droplet of the ink to be ejected is reduced. As an ink droplet is reduced, it becomes difficult to eject the ink droplet on the optical axis of the photo-interrupter with good accuracy. To resolve such problem, the configuration is considered in which ink is detected by moving a recording head ejecting the ink in the vicinity of the optical axis of the photo-interrupter and allowing the ink droplet to cross the optical axis by the ejection while the recording head is moving.

However, in a color ink jet recording apparatus which records a color image by ejecting a plurality of color inks, since light shielding characteristics for a photo-interrupter are different from each other according to the color difference in each of the plurality of color inks, there is a problem that the reliability of a decision result is decreased when each color ink is detected in the same sequence. Moreover, in recent years, to improve gradation, the configuration is also proposed in which recording is performed using a plurality of inks having different density in the same color. Since light shielding characteristics differ in the ink having such different density, a problem will occur in which the reliability of a decision result is decreased in the same manner as the color inks if the inks are detected in the same sequence.

Further, in the latter system which detects a recorded mark, while its detection accuracy is high, a mark must be recorded on a recording medium independently of the information to be recorded actually to detect the presence of ink. Accordingly, there are problems that an originally unnecessary mark will be recorded on the recording medium as a recording result or the recording medium will be used wastefully. In this case, a sensor for reading the mark with high accuracy is necessary.

SUMMARY OF THE INVENTION

The present invention is intended in consideration of the above conventional examples, and an object of the present invention is to provide an ink jet recording apparatus which enables decision of the presence of ink ejection with good accuracy regardless of ink colors and an ink detection method in the pertinent apparatus.

To attain the above object, an ink jet recording apparatus according to the present invention comprises the following configuration.

That is, an ink jet recording apparatus which performs recording on a recording medium by ejecting inks of a plurality of different colors by the use of an ink jet head for ejecting the inks, comprises moving means for moving the ink jet head to the recording medium, detecting means, installed at a predetermined position within the moving area of the ink jet head by the moving means, for detecting the inks ejected from the ink jet head and outputting a detection signal in accordance with a detection result, ink ejecting means for moving the ink jet head by the moving means and ejecting the inks from the ink jet head within the predetermined area including the predetermined position, deciding means for deciding the presence of ink ejection by the ink ejecting means on the basis of a detection signal output from the detecting means, and control means for changing at least one condition of the ink ejection cycle by the ink ejecting means, the moving speed of the ink jet head by the moving means and the number of the inks ejected within the predetermined area by the ink ejecting means, in accordance with the colors of the inks.

Further, to attain the above object, an ink detection method in an ink jet recording apparatus of the present invention comprises the following steps.

That is, an ink detection method in an ink jet recording apparatus which performs recording on a recording medium by ejecting inks of a plurality of different colors by the use of an ink jet head for ejecting the inks comprises a moving step of moving the ink jet head to detecting means, installed at a predetermined position within an area to which the ink jet head is moved, for detecting the inks ejected from the ink jet head and outputting a detection signal in accordance with a detection result, an ink ejecting step of ejecting the inks from the ink jet head when the ink jet head is located in the predetermined area including the predetermined position during the moving of the ink jet head in the moving step, and a deciding step of deciding the presence of ink ejection by the ink ejecting means on the basis of the detection signal output by the detecting means, at least one condition of the ink ejection cycle by the ink ejecting means, the moving speed of the ink jet head by the moving means and the number of the inks ejected within the predetermined area by the moving means being changed, in accordance with the colors of the inks.

Further, an ink jet recording apparatus of the present invention is directed to an ink jet recording apparatus which performs recording on a recording medium by ejecting a plurality of inks which differ in light shielding characteristics, said ink jet recording apparatus comprises, a carriage equipped with an ink jet head for ejecting the inks, main scanning means for scanning the ink jet head mounted on the carriage by scanning the carriage to the recording medium along a main scanning direction, detecting means which is located at a predetermined position within the scanning area of the ink jet head scanned by the main scanning means and which comprises light emitting means for emitting light in a direction different from the main scanning direction and light reception means for receiving the light emitted by the light emitting means and which outputs a signal according to whether or not an optical axis formed between the light emitting means and the light reception means is intercepted, ejection control means for scanning the ink jet head by the scanning means and for ejecting the ink from the ink jet head within the predetermined area including the optical axis of the detecting means, deciding means for deciding the presence of ink ejection by the ejection control means on the basis of a detection signal output from the detecting means, and control means for changing at least one condition of the ejection cycle of the ink ejected by the ejection control means, the scanning speed of the ink jet head by the main scanning means, a position of the start of the ink ejection by the ejection control means and the number of inks ejected within the predetermined area by the ejection control means, in accordance with the light shielding characteristics of the inks ejected by the ejection control means among the plurality of different inks.

Furthermore, the present invention is an ink detection method in an ink jet recording apparatus which moves an ink jet head for ejecting ink to a recording medium and which performs recording on the recording medium by ejecting a plurality of inks different in light shielding characteristics, and said ink detection method comprises, a moving step of moving the ink jet head to detecting means which is located at a predetermined position within an area to which the ink jet head is moved and which comprises light emitting means for emitting light and light reception means for receiving the light and which outputs a signal according to whether or not an optical axis formed between the light emitting means and the light reception means is intercepted, an ink ejecting step of ejecting the ink from the ink jet head when the ink jet head is located within the predetermined area including the predetermined position during the moving of the ink jet head in the moving step, and a deciding step of deciding the presence of ink ejection by the ink ejecting means on the basis of the detection signal output by the detecting means, wherein at least one condition of the ejection cycle of the ink ejected by the ink ejecting means, the travel speed of the ink jet head, the position of the start of the ink ejection by the ink ejecting means and the number of the inks ejected within the predetermined area by the ink ejecting means are changed in accordance with the light shielding characteristics of the ink.

DESCRIPTION OF THE PREFERRED EMBODIMENTS

The embodiments of the present invention are described below in details with reference to the drawings. Besides, the following example takes a facsimile machine as a recording apparatus which performs recording using an ink jet system by way of example.

Figure 1:
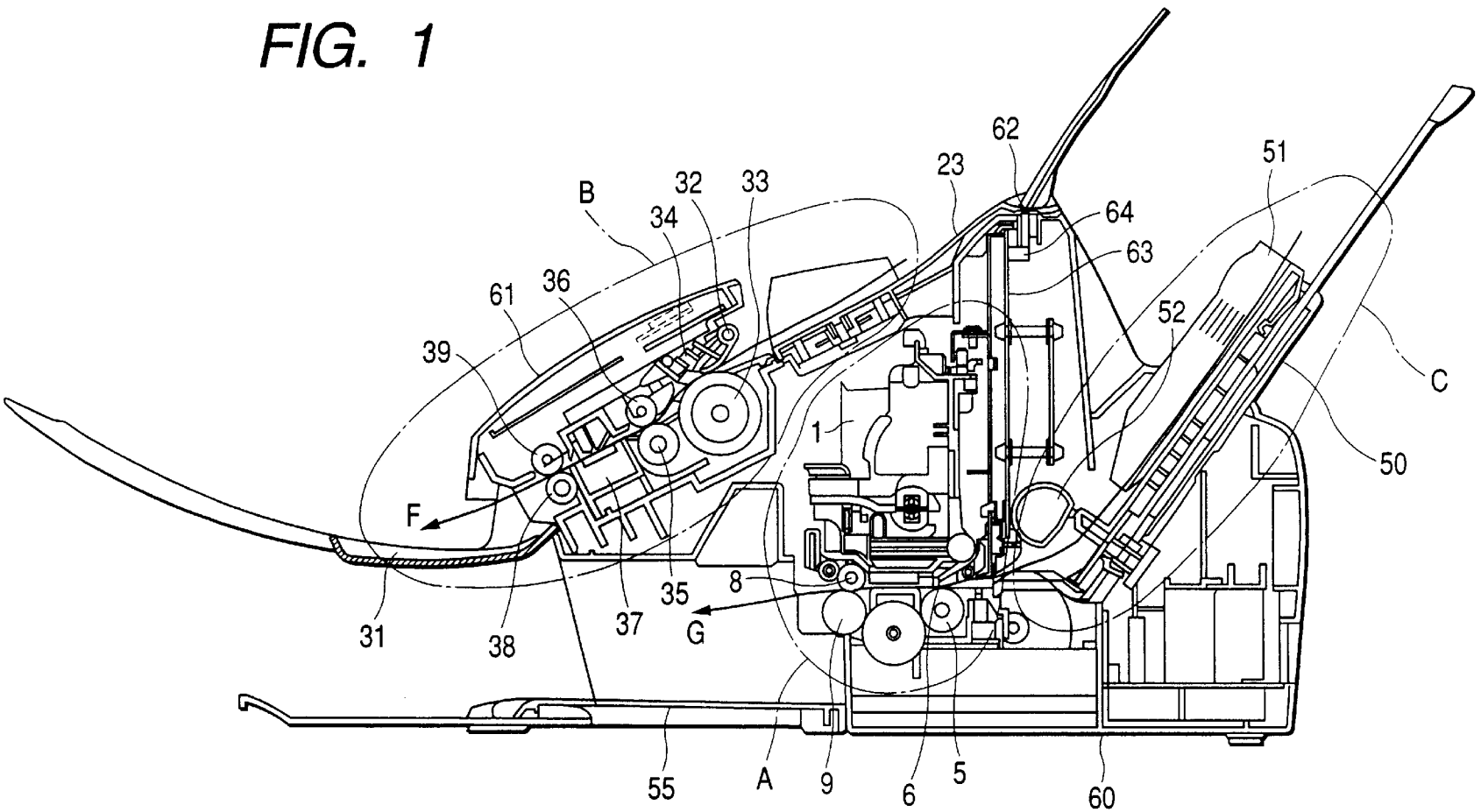
FIG. 1 is a sectional view showing a facsimile machine.

FIG. 1 is a sectional view of a facsimile machine to which the present invention applies. In FIG. 1, A is a recording unit which is an ink jet recording apparatus, B is a reading unit which optically reads a document and C is a paper feeding unit which separates loaded recording paper and supplies it to the recording unit.

In this diagram, first, a flow of a recorded material (hereinafter referred to as recording paper) which is a recording medium is outlined. A series of recording paper conveying routes are shown by an arrow G. In this embodiment, a regular cut sheet is used. A plurality of cut sheets are piled up and accommodated in an auto sheet feeder 50. The auto sheet feeder 50 is comprised so that the side of recording paper can be guided by a slider 51 in accordance with the size of the recording paper.

First of all, only a sheet of recording paper 12 accommodated in and loaded on the auto sheet feeder 50 is separated and conveyed by a paper feed roller 52 and a paper picker not shown. Subsequently, the sheet is inserted and conveyed by a conveying roller 5 and a roll 6 arranged facing it.

A recording unit comprises a paper ejection roller 9 which conveys, to the downstream of an apparatus, the printed recording paper 12 on which recording is performed by a recording head 1 and which is located at the downstream of the recording head 1, and a rowel spur 8 which is located at the opposed side of the paper ejection roller and which is made of a material to which ink is not transferred even if the rowel spur touches the printing surface of the recording paper 12.

The recording paper conveyed by the paper ejection roller 9 and the rowel spur 8 is ejected on a recording paper ejection tray 55 installed at the bottom of an apparatus main unit 60.

Further, 23 is a cover which can be opened and closed, and the space required for replacement of the recording head 1 is opened in an opened state.

Next, a flow of a sheet material (hereinafter referred to as a document) is described.

A series of document conveying routes are shown by an arrow F. When one document or a plurality of documents are loaded on a cover 23 which serves both as a document loading tray, the presence is detected by a document presence sensor which detects the presence of a document not shown. Then, when a start button not shown is pressed by the operator at sending and copying respectively, the document is inserted and the front end is loosened by a separation roller 33 which is rotated by a stepping motor not shown that is a driving source and a preliminary conveying pushing arm 32.

Subsequently, a plurality of documents are separated one by one in a separation unit consisting of the separation roller 33 and a friction flake unit 34 and is inserted and conveyed by a paper feed roller 35 which is rotated by the stepping motor and a paper feed roll 36 arranged facing it. The front end is detected by a document front-and-rear end sensor not shown which detects the front and rear ends of the document.

Subsequently, the rear end of a document is detected by the document front-and-rear end sensor reading the image data of the document by a contact sensor 37 which is a document reading device. A paper ejection roller 38 which is rotated by the stepping motor is rotated for a predetermined amount according to the output from the document front-and-rear end sensor. The document is inserted and conveyed by the paper ejection roller 38 and a paper ejection roll 39 arranged facing it and is loaded on a cover 31 which serves both as a document paper ejection tray.

Figure 2:
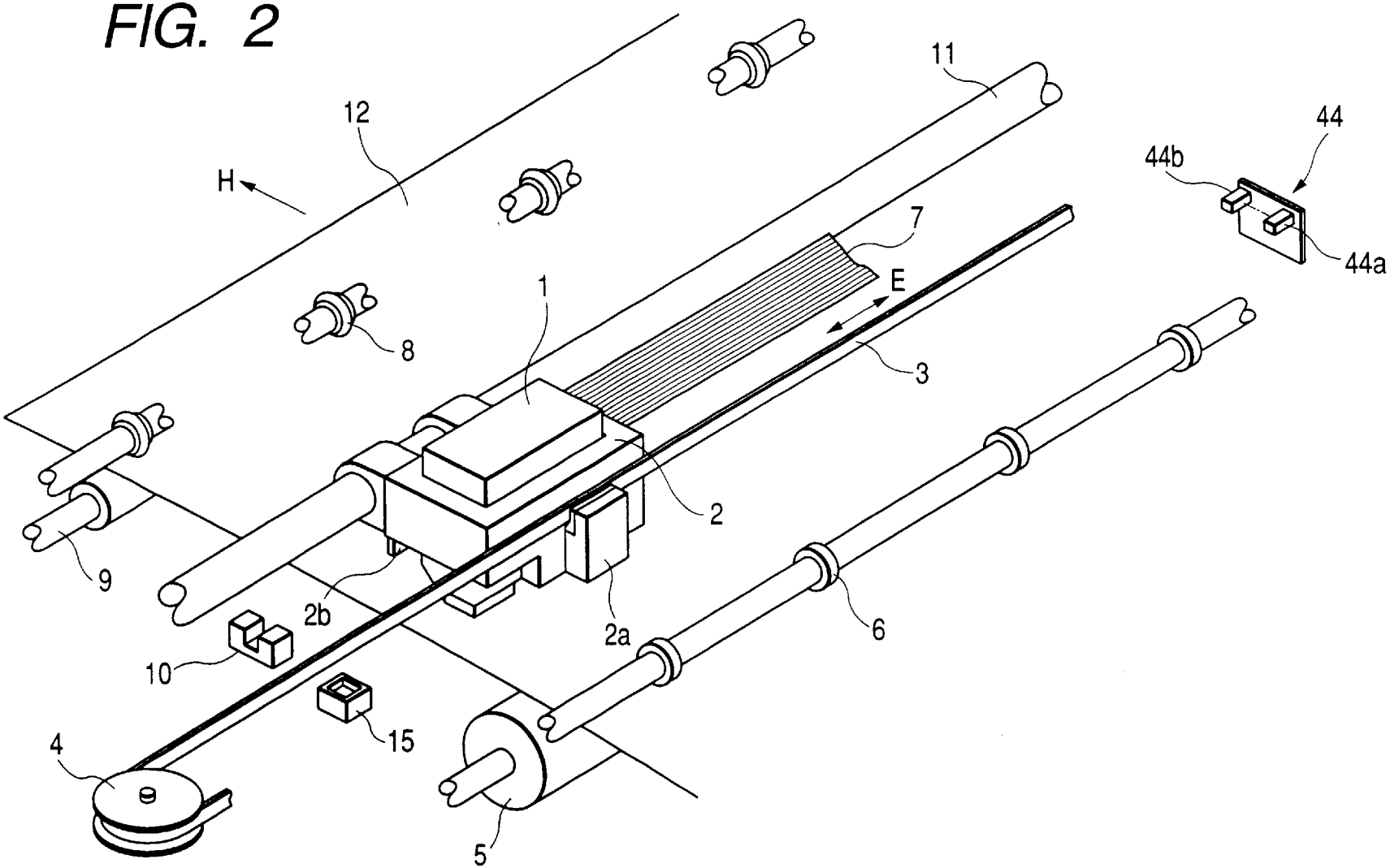
FIG. 2 is a perspective diagram showing the configuration of an ink jet recording unit.

Next, the configuration of the recording unit A according to an embodiment of the present invention is described in detail using FIG. 2. In FIG. 2, 1 is a recording head. This embodiment mounts a cartridge type ink jet recording head which is formed with an ink tank and which can be replaced with a new one every recording head when ink was exhausted. 2 is a carriage for reciprocally moving the recording head 1 to the rectangular direction against the conveying direction H (sub scanning direction) of the recording paper 12, that is, the main scanning direction E holding it with good accuracy and is held by a guide rod 11 and a butt unit 2*a* so as to freely slide. The reciprocal movement of the carriage is performed by a pulley 4 and a timing belt 3 which are driven by a motor not shown. At this time, the print signal and power applied to the recording head 1 is supplied from the electric circuit of the main unit through a flexible cable 7. The recording head 1 and the flexible cable 7 are connected by press-fitting mutual contact points.

Further, 15 is a cap which functions as ink receiving means and is installed corresponding to the position (home position) where the carriage 2 waits. The cap ascends and descends as occasions demand, and when it ascends, evaporation of ink and adhesion of dust are prevented by sticking it fast to the recording head 1 and covering a nozzle unit.

In an embodiment of the present invention, to position the recording head 1 and the cap 15 so that they can be set at a relatively opposed position, a carriage home sensor 10 installed a recording apparatus main unit and a light shielding plate 2*b* installed in the carriage 2 are used. The carriage home sensor 10 consists of a transmission type photo-interrupter. When the carriage 2 moves and reaches the home position, it detects that the recording head 1 and the cap 15 are set at the relatively opposed position using the fact that the transit of the light sent from a part of the carriage home sensor 10 is intercepted by the light shielding plate 2*b*. The recording paper 12 is fed from the right in the diagram and is conveyed to the direction (sub scanning direction) shown by an arrow H, by the conveying roller 5 and the pushing roll 6 which is separated from a bearing member not shown at a predetermined length and arranged facing the conveying roller 5. The conveying roller 5 and the paper ejection roller 9 are driven by a driving system not shown respectively and the recording paper 12 is conveyed to the sub scanning direction with high accuracy interlocking with the reciprocal movement of the carriage 2 as occasions demand. Further, 8 is called a rowel spur and is made of a material with high water repellency so that it can touch the recording paper 12 only on the recording paper surface and a blade-shaped peripheral unit. The rowel spur is arranged by being separated at a predetermined length by a bearing member not shown and is comprised so that the recording paper 12 can be guided and conveyed without affecting an image even if the rowel spur touches unfixed ink on the recording paper immediately after it has been printed.

The present invention, as shown in FIG. 2, decides whether ink is normally ejected or not using a transmission type photo-interrupter type sensor 44 having a light emitting element 44*a* and a light reception element 44*b* as an ink detection sensor. In such configuration, it is decided that there is ink in an ink tank and the ink is normally ejected by detecting that the optical axis between the light emitting element 44*a* and the light reception element 44*b* was intercepted since the ejected ink crosses. Further, by arranging the cap 15 of ink receiving means on the reverse side of the main scanning direction E, the stain of the sensor 44 caused by ink spraying is prevented when the recording head 1 is capped. Besides, this sensor 44 is a sensor for detecting the interception of the optical axis due to an ink droplet and deciding that the ink is ejected. Since the sensor can also decide that there is a remaining ink amount from the result that the ink is normally ejected, it is also described as a remaining ink amount detection sensor.

First Embodiment

This embodiment aims at the fact that a characteristic in which the optical axis of the sensor 44 is intercepted differs depending on the color of ink to be detected, and an object of this embodiment is to be surely able to detect whether the ink is normally ejected by changing a detection condition corresponding to this light shielding characteristic.

The recording head 1 used in this embodiment ejects ink from an ejection port at the tip of a nozzle by the pressure of film boiling which occurred in the ink caused by the generation of the heat of an electrothermal converting element installed in the nozzle. In a facsimile machine of this embodiment, as this recording head 1, two types of recording heads, that is, a monochrome recording head for black ink in which 128 nozzles are arranged in accordance with the resolution of 360 DPI (dots per inch) and a color recording head in which 64 nozzles for black ink and 24 nozzles respectively which correspond to each color of yellow, magenta and cyan are arranged in accordance with the resolution of 360 DPI can be used. These two types of recording heads have a 1-column nozzle column respectively. For the color recording head, the nozzle column which corresponds to each color is comprised by dividing the 1-column nozzle column into a plurality of areas which correspond to each color. Further, by properly using these two types of recording heads, two types of printing of high-speed monochrome printing and high-definition full color printing can properly be used.

Next, the ejection principle of a recording head used in an ink jet recording apparatus of this embodiment as recording means in the present invention is described. A recording head unit applied to the ink jet recording apparatus generally comprises a fine liquid ejection port (orifice), a liquid path and an energy action unit installed in a part of this liquid path and energy generating means which generates liquid droplet forming energy that operates on a liquid at the action unit, and can be replaced.

Such energy generating means that generates energy includes means which uses an electromechanical converting element such as a piezoelectric element, means which irradiates electromagnetic waves such as laser, causes a liquid existing there to absorb the irradiated waves and generate heat, and ejects and sprays a liquid droplet by the generation of heat action or means which heats a liquid and ejects the liquid by an electrothermal converting element. Above all, an ink jet recording system which ejects a liquid by thermal energy can arrange a liquid ejection port (orifice) for ejecting a liquid droplet for recording to form a flying liquid droplet, in a recording head unit at high density, and can attain high-resolution recording.

Further, a recording head unit which uses an electrothermal converting element as energy generating means is also easy to make compact wholly as the recording head unit and can make full use of the advantages of IC technology and micro processing technology in which the technical advancement and improvement of reliability in the field of the latest semiconductor are remarkable, thereby being easy to make long and spherical (two-dimensional). Accordingly, an ink jet recording head unit whose application of multiple nozzles and high-density packaging are facilitated, whose productivity is good in large quantities and whose production cost is also inexpensive can be provided.

A recording head unit for an ink jet manufactured via the semiconductor production process using an electrothermal converting element as energy generating means in this manner generally has the structure in which a liquid path is installed corresponding to each ink ejection port, the electrothermal converting element is installed as means which forms a flying liquid droplet by acting thermal energy on a liquid filled with the liquid path every liquid path and ejecting the liquid from the corresponding ink ejection port and the liquid is supplied to each liquid path from a common liquid chamber which communicates to each liquid path.

Figure 3:
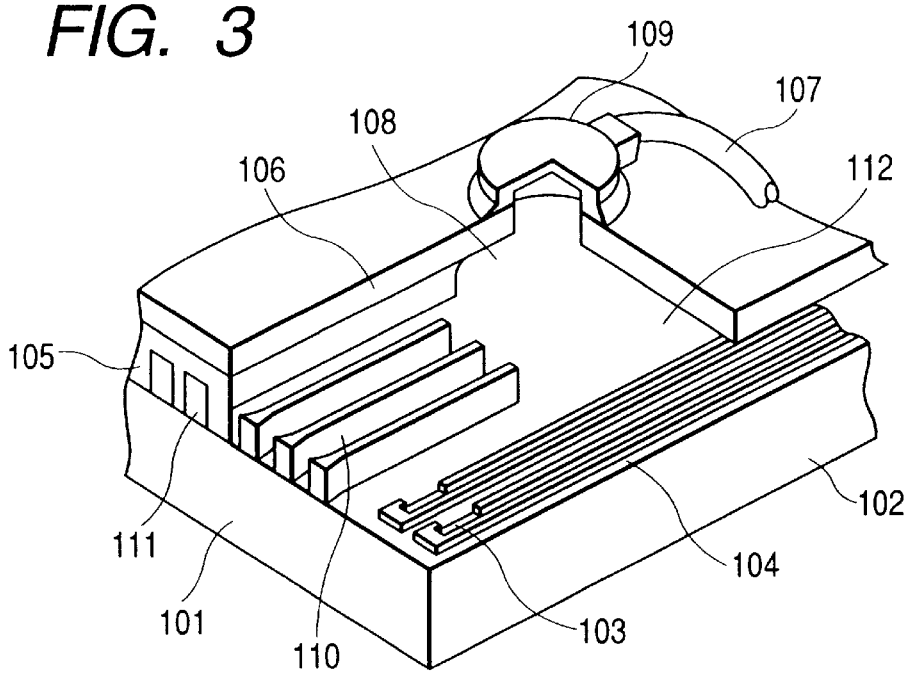
FIG. 3 is a perspective diagram showing the configuration of a recording head.

FIG. 3 shows a schematic block diagram of the aforementioned ink jet head unit. A recording head unit 101 comprises a cured active energy line curing material layer 105 having a liquid path 110, an electrode 104 and an electrothermal converting element 103 deposited on a PC board 102 which is a first PC board via the semiconductor production process such as etching evaporation and sputtering and a top plate 106. In such recording head unit 101, a liquid 112 for recording is supplied from a liquid storage chamber not shown to a common liquid chamber 108 via a liquid supply pipe 107.

109 is a connector for the liquid supply pipe 107. A recording liquid 112 supplied to the common liquid chamber 108 is supplied to the liquid path 110 by capillarity and is held since a meniscus is formed at an ink ejection port 111 at the tip of the liquid path. Then, by conductively connecting the electrothermal converting element 103, a liquid on the electrothermal converting element surface is heated, a bubbling phenomenon occurs due to film boiling and a liquid droplet is ejected from the ink ejection port 111 due to the growth of a bubble. The aforementioned configuration enables an ink jet recording head unit having multiple nozzles to be formed using high-density liquid path piping, such as ejection port density of 360 to 400 dots per inch.

The present invention will have an excellent effect on an ink jet recording apparatus which forms a flying liquid droplet and performs recording using thermal energy even in an ink jet recording system in particular.

For the typical configuration and principles, for example, it is desirable that the basic principles disclosed in the Specifications of U.S. Pat. Nos. 4,723,129 and 4,740,796 be used. This system can apply to either case of the so-called on-demand type and continuance type. In particular, for the on-demand type, by applying at least one driving signal which corresponds to recording information and enables a sudden temperature rise exceeding film boiling to an electrothermal converting element arranged corresponding to a sheet or liquid path at which a liquid (ink) is held, it is effective since thermal energy is generated in the electrothermal converting element, the film boiling is generated on the thermal action surface of a recording head and eventually, a bubble can be formed in the liquid (ink) which corresponds to this driving signal one-to-one. The growth or contraction of this bubble ejects an liquid (ink) via an ejection opening and forms at least one droplet. If this driving signal is formed into a pulse shape, the growth or contraction of the bubble is immediately performed properly. Accordingly, since the ejection of a liquid (ink) excellent in responsiveness in particular can be attained, the on-demand type is more desirable.

As a driving signal having this pulse shape, ones which are described in the Specifications of U.S. Pat. Nos. 4,463,359 and 4,345,262 are suitable. Besides, if the conditions described in the Specification of U.S. Pat. No. 4,313,124 of the invention regarding the temperature rise rate on the aforementioned thermal action surface are employed, more excellent recording can be performed.

The configuration of a recording head may include the configuration in which the Specifications of U.S. Pat. Nos. 4,558,333 and 4,459,600 which disclose the configuration in which a thermal action unit is arranged in a bent area is used in addition to the combined configuration (a linear liquid flow path or rectangular liquid flow path) of such ejection port, liquid path and electrothermal converting element as disclosed in each of the specification described above. Besides, the configuration can be included based on Japanese Patent Application Laid-Open No. 59-123670 (1984) which discloses the configuration in which a common slit is used as an ejection unit of an electrothermal converting element to a plurality of electrothermal converting elements and Japanese Patent Application Laid-Open No. 59-138461 (1984) which discloses the configuration in which an opening which absorbs pressure waves of thermal energy is made to correspond to the ejection unit.

In addition, a replaceable chip type recording head which enables electric connection with an apparatus main unit and supply of ink from the apparatus main unit by being mounted on the apparatus main unit or a cartridge type recording head in which an ink tank is installed in a recording head itself in one body may also be used.

Further, it is desirable that recovery means, preliminary auxiliary means or the like is added to a recording head, because the effect of the present invention can be made more stable. Typical examples of these means include capping means, cleaning means, pressurizing means, sucking means, an electrothermal converting element, a heating element other than this element, and preliminary heating means consisting of a combination thereof for the recording head. In addition, it is also effective for the sake of stable recording to perform a preliminary ejection mode for ejection instead of recording.

Furthermore, recording modes of a recording apparatus may include not only the recording mode of a primary color such as black but also the mode in which a recording head is comprised in one body or a plurality of recording heads are combined. Otherwise, a device comprising at least one of double colors having different colors or full colors based on a color mixture can be used.

In the embodiment of the present invention described above, ink is described as a liquid. However, the ink may be ink which is solidified at room temperatures or lower temperatures and is softened at room temperatures or a liquid. That is, when the ink is used for recording, the ink may be liquefied.

In addition, a temperature rise caused by thermal energy is prevented by actively using ink as the energy as the status change from the solid state to liquid state of the ink or the ink solidified in an exposed state is used for the purpose of preventing evaporation of the ink. At any event, the ink is liquefied by the application of the thermal energy which corresponds to a recording signal and is ejected as liquefied ink or it already starts being solidified when it reaches a recording medium. Like this, the use of the ink having properties of being liquefied by the thermal energy can also be applied to the present invention. In such case, the ink may be such form as is opposed against an electrothermal converting element while it is being held in a porous sheet recessed part or through hole as a liquefied or solid body, as described in Japanese Patent Application Laid-Open No. 54-56847 (1979) or Japanese Patent Application Laid-Open No. 60-71260 (1985). In the present invention, the most effective thing for each ink is to execute the aforementioned film boiling system.

Figure 4:
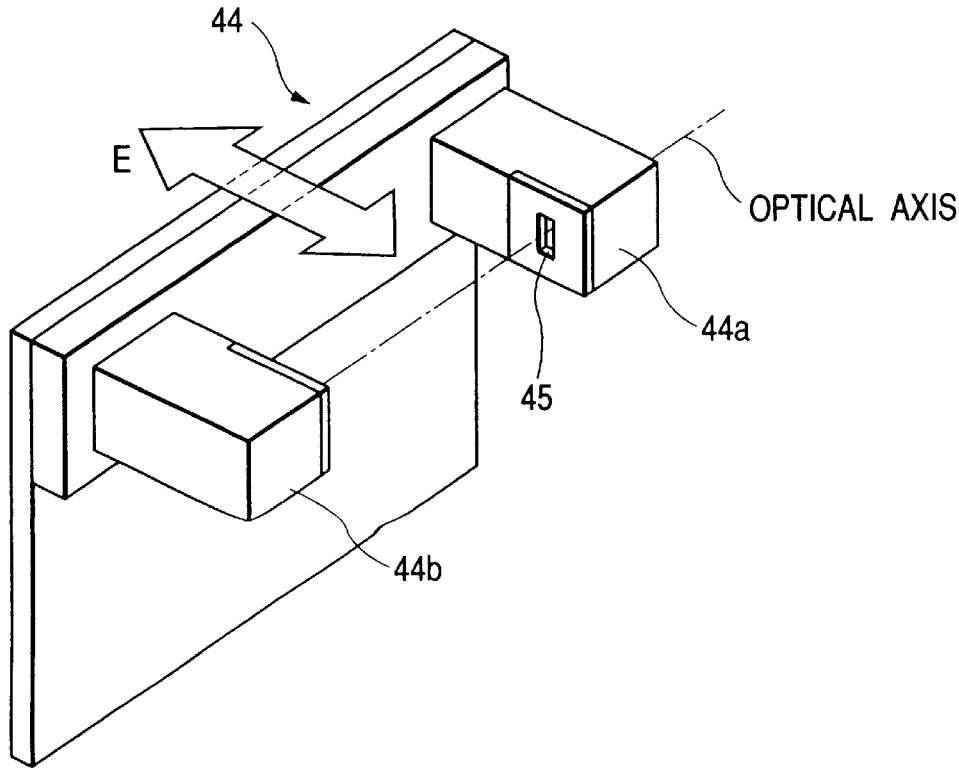
FIG. 4 is a perspective diagram of a photo-interrupter type sensor.

FIG. 4 is a perspective diagram of the ink detection sensor 44. To increase the light shielding rate of an optical axis by ink, detection accuracy is increased by installing a slit 45 on both the sides of the light emitting element 44*a* and the light reception element 44*b*.

Besides, to perform positioning so that,the nozzle column of the recording record 1 and the ink detection sensor 44 can be set at a relatively opposed position, the carriage home sensor 10 installed in an apparatus main body is used in the same positioning with the cap 15.

In this embodiment, the moving distance from the home position (HP) to the optical axis of the ink detection sensor 44 is set in a control program which previously executes recording operation by being converted to the number of steps of the carriage motor 30 not shown which drives the carriage 2. Thus, after the home position has been detected, the position of the ink ejection column of the recording head 1 and the optical axis between the light emitting element 44*a* and the light reception element 44*b* of the ink detection sensor 44 are positioned when the carriage 2 was moved for a predetermined amount.

Further, in this embodiment, since the diameter of an ink droplet ejected from a recording head is small, the recording head 1 is moved ejecting ink from the recording head 1 in the vicinity of the optical axis including this optical axis. Moreover, in this embodiment, an attempt is made to allow the ink droplet to surely cross the upper part of this optical axis by ejecting the ink droplet using predetermined values of the ejection start position, the ejection cycle, the number of ejection times or the travel speed of the carriage 2 according to the color of the ink to be ejected.

Figure 5:
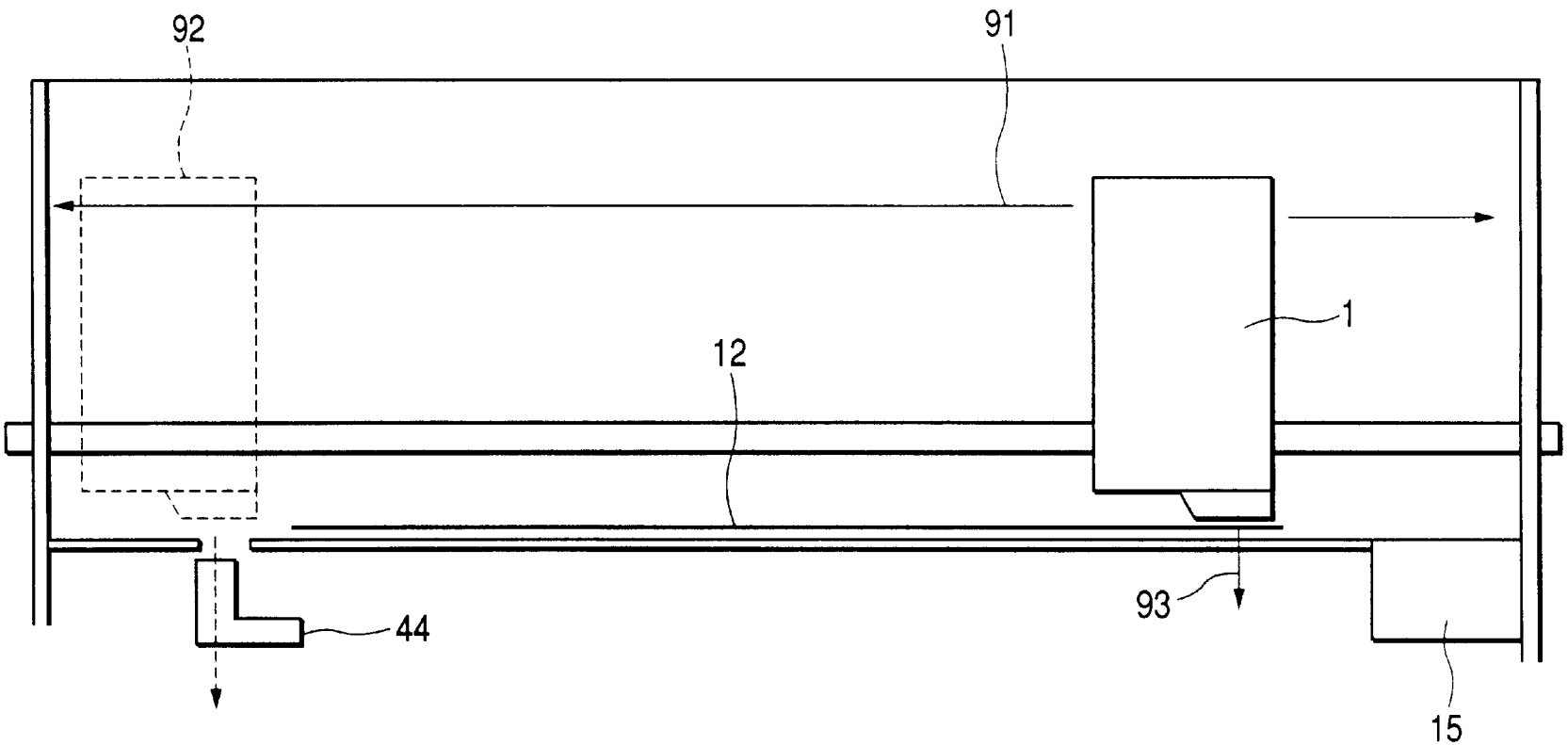
FIG. 5 is a schematic illustration of the ejection position for ink ejection detection in the present invention.

FIG. 5 is a schematic diagram showing the ejection position at the time when the presence of ink ejection of this embodiment is decided. In FIG. 5, 91 shows the movable range of the recording head 1 to be moved and scanned. Further, the acceleration or deceleration area of the recording head 1 is installed at both ends of the printable range and the movable range of the recording head 1 in this embodiment is about 333 mm. Furthermore, 92 is the position of the recording head 1 at the time when it is detected whether ink is normally ejected from the sensor 44. Moreover, 93 is the ejection direction of the ink and the recording paper 12 is conveyed from the side of the inner part toward this side in the diagram.

Figure 6:
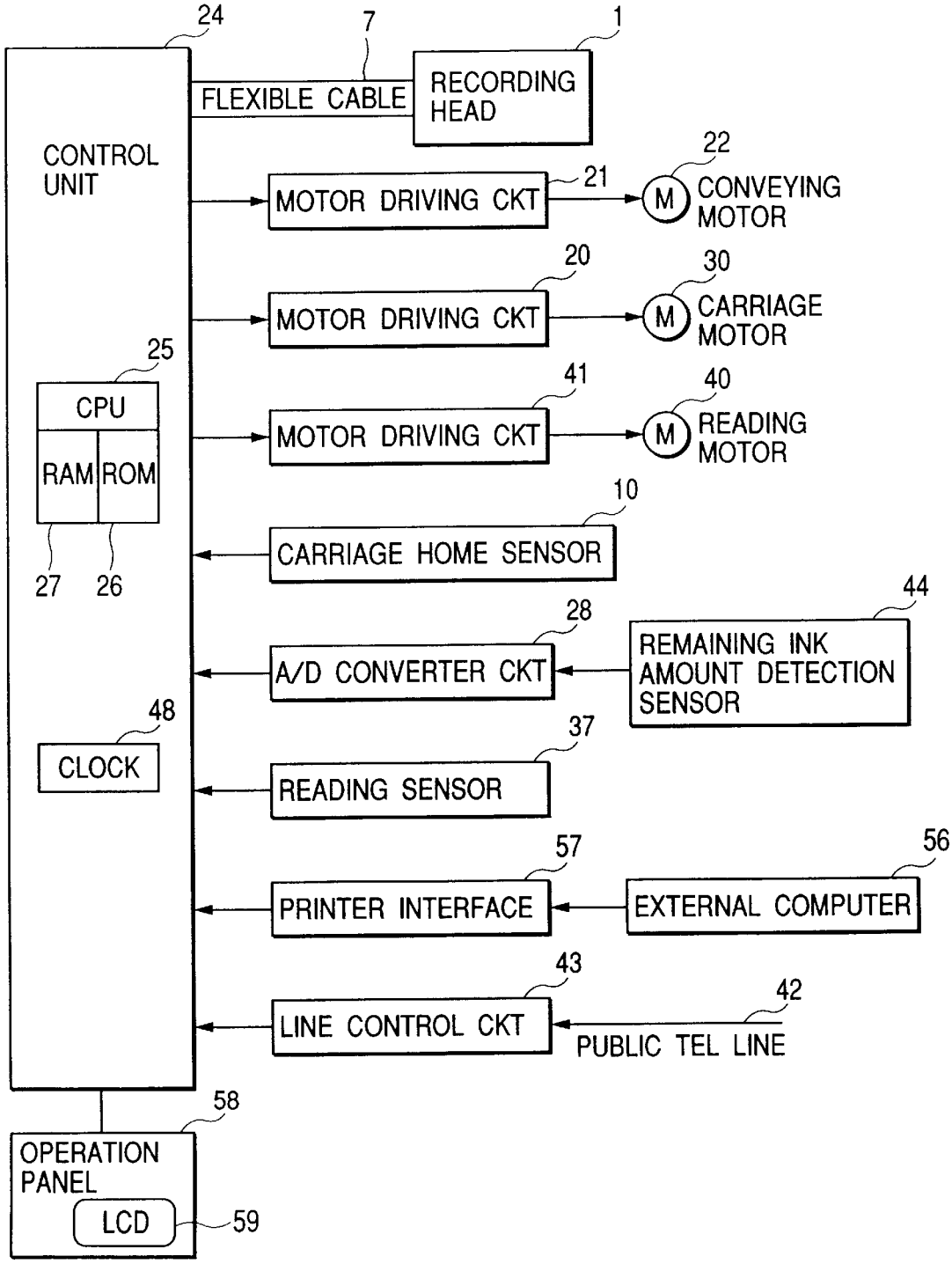
FIG. 6 is a block diagram of the control configuration of the present invention.

FIG. 6 is a block diagram showing the control configuration of an ink jet recording apparatus of this embodiment.

In FIG. 6, 24 is a control unit for controlling the whole apparatus. The control unit 24 comprises a CPU 25, a ROM 26 which stores the control program the CPU 25 executes and various data and a RAM 27 for temporarily stores the various data. Besides, the processing which conforms to the flowchart of FIG. 9 described later is executed by the CUP 25 using the control program stored in the ROM 26 in this embodiment.

As shown in FIG. 6, the recording head 1 is connected to the control unit 24 via the flexible cable 7 and the flexible cable 7 includes control signal lines and image signal lines from the control unit 24 to the recording head 1. Further, the output of the ink detection sensor 44 is input to the control unit 24 via an A/D converter circuit 28 and the CPU 25 has the configuration in which it can analyze the ejected state of ink according to the A/D converted digital value. Furthermore, the control unit 24 controls a carriage motor 30 via a motor driving circuit 20, the rotation of a conveying motor 22 via a motor driving circuit 21 and the rotation of a reading motor 40 via a motor driving circuit 41.

Moreover, the control unit 24 connects a printer interface 57 which receives a recording instruction and recording data from an external computer 56. The control unit 24 also receives the data from a public telephone line 42 via a line control circuit 43. Further, the control unit 24 connects an operation panel 58 on which the apparatus user performs various operations and instructions, and this operation panel 58 installs a display unit (LCD) 59 for displaying various messages for the operator. 48 is a reference clock described later.

Figure 7:
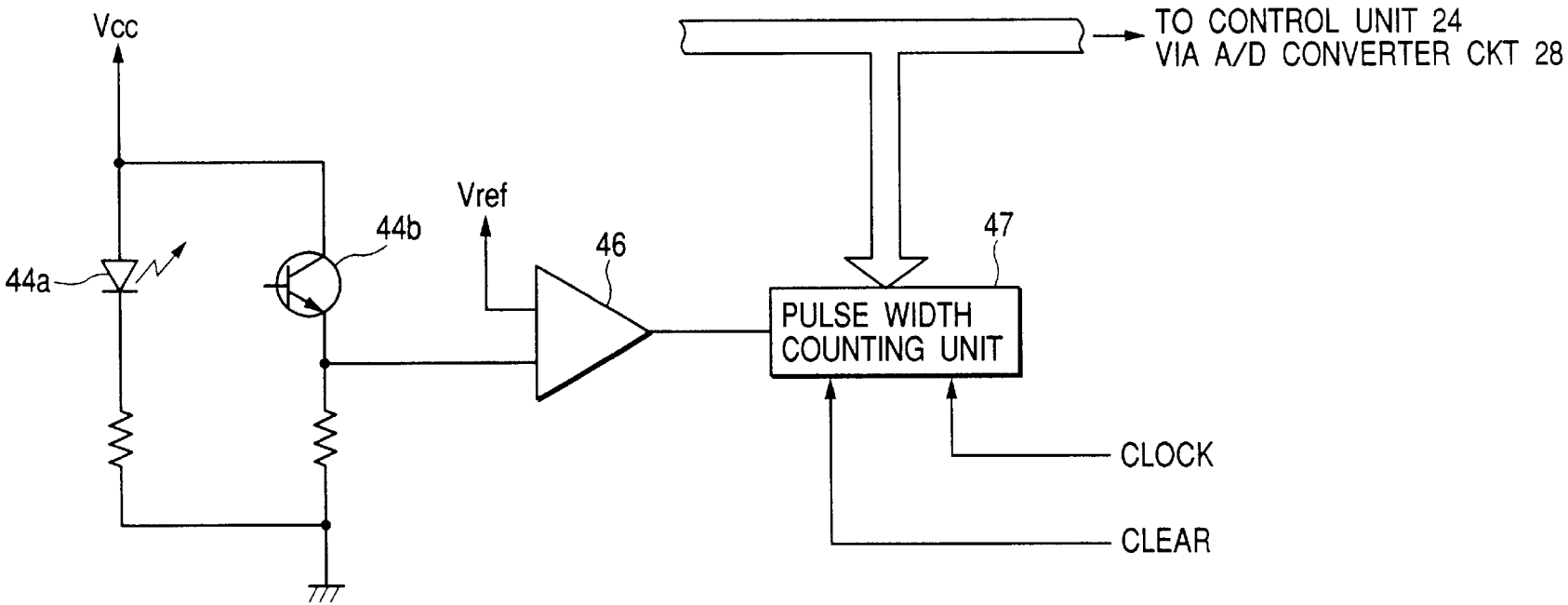
FIG. 7 is a block diagram of the electrical configuration of a photo-interrupter type sensor.

FIG. 7 is a block diagram showing the electrical configuration of a remaining ink amount detection sensor. In FIG. 7, 44*a* is an infrared LED which is a light emitting element, 44*b* is a phototransistor which is a light reception element which receives the infrared light, 46 is a comparator which inputs the output of the phototransistor 44*b* and 47 is a pulse width counting unit which measures the duration time (pulse width) of a pulse output from the comparator 46. The pulse width counting unit 47 uses the pulse width of an input clock (reference clock) as a reference pulse width, counts that the duration time of the pulse output from the comparator 46 is what cycles of the reference clock and the count value is output to the internal register of the pulse width counting unit.

If ink is not ejected from the recording head 1, since the infrared light from an infrared LED which is a light emitting element is not intercepted, a signal having the high (H) level is input from the phototransistor 44*b* which is a light reception element to the comparator 46. Conversely, when there is a remaining ink amount and the ink is normally ejected from the recording head 1, the ejected ink intercepts the infrared light from the infrared LED. Accordingly, an output level from the phototransistor 44*b* drops. Then, when the output level goes below a reference voltage (Vref) input to the comparator 46, the output from the comparator 46 to the pulse width counting unit 47 is reversed. Subsequently, when the ejection of ink from the recording head 1 is completed, the output from the phototransistor 44*b* reaches the high (H) level. When the reference voltage (Vref) input to the comparator 46 is exceeded, the output from the comparator 46 to the pulse width counting unit 47 is re-reversed.

Thus, a pulse in which the time the phototransistor 44*b* is detecting ejected ink is counted as a pulse width is input to the pulse width counting unit 47. As described above, this pulse width is measured using a reference clock and is stored in the RAM 27 of the control unit 24. This count value is read by the CPU 25 of the control unit 24 after ink ejection has been completed. Since it is known from the count value whether the ink is normally ejected, the count value is used for judgment of the presence of ink.

Besides, the clock frequency of the reference clock 48 in the aforementioned embodiment is about 56.5 [1/msec], and the threshold of judgement as to whether ink was ejected is 80 pulses for Bk ink and 30 pulses for Y, M or C ink.

Figure 8:
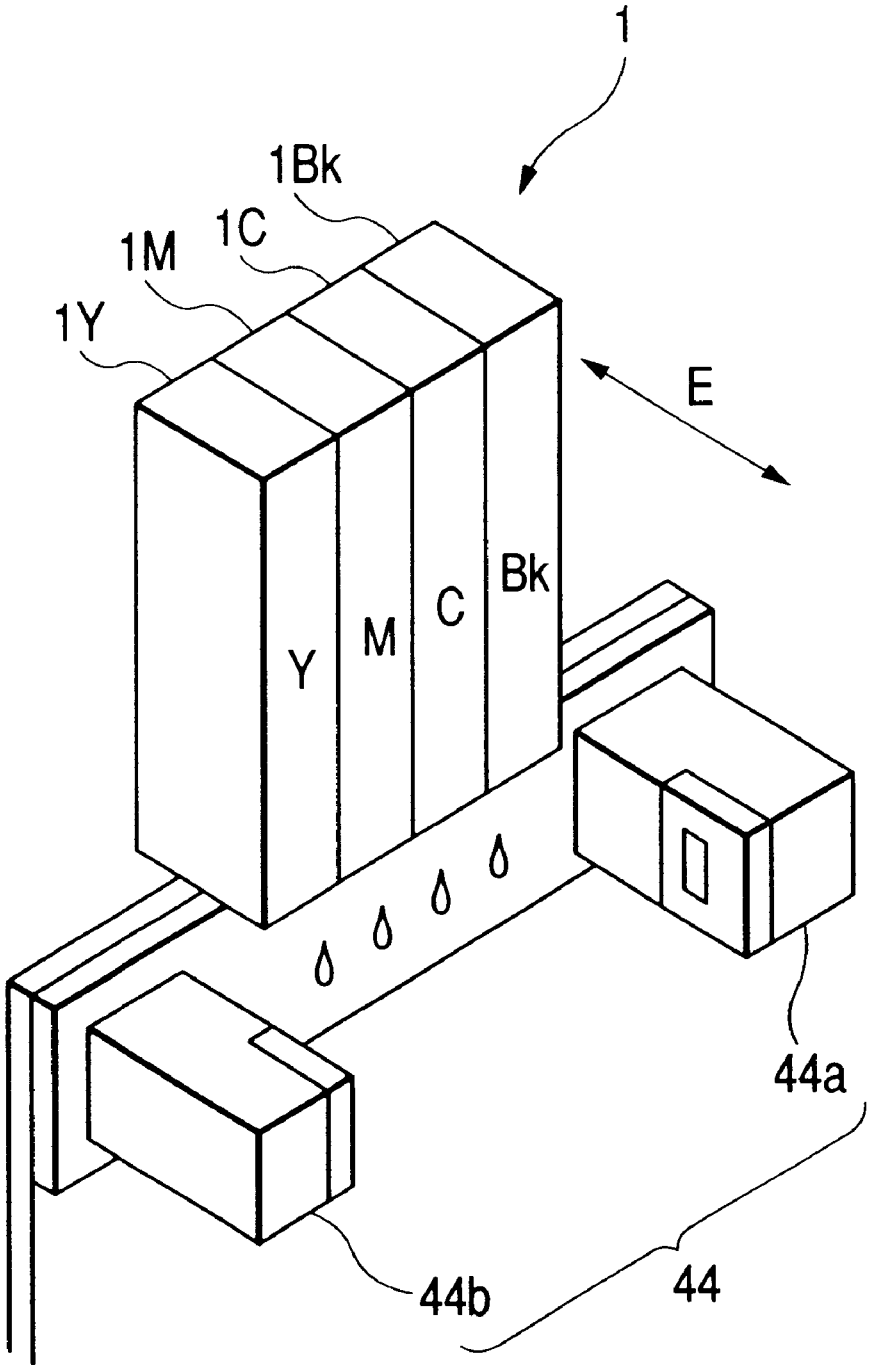
FIG. 8 is a perspective diagram of the position relationship between a photo-interrupter type sensor and a recording head.

FIG. 8 typically shows the configuration of the recording head 1 and the detection means 44 of this embodiment. The recording head 1 shown in FIG. 8 is a color recording head which can eject a plurality of color inks, and in this embodiment, has heads 1Y, 1M, 1C and 1Bk which eject the ink having each color of Y (yellow), M (magenta), C (cyan) and Bk (black). Further, the number of nozzles of each head is, for example, 24 for the heads 1Y to 1C respectively and 64 for the head 1Bk. Furthermore, in the example shown in FIG. 8, the head which corresponds to each color is arranged. In this case, the configuration may be used in which each area is made to correspond to the ink of each color by dividing the nozzle column (or nozzle array) of one head into a plurality of areas.

Moreover, the nozzles of these heads 1Y, 1M, 1C and 1Bk are arranged in one column in the direction which is almost normal to the scanning direction (direction shown by an arrow E) of the recording head 1. Further, the optical axis which connects the light emitting element 44*a* and the light reception element 44*b* is arranged almost in parallel with the nozzle column of the recording head 1 and the spacing between the light emitting element 44*a* and the light reception element 44*b* is comprised longer than the length of the nozzle column of the recording head 1. For decision of the presence of a remaining ink amount, when the detection as to whether ink is normally ejected from the recording head 1 or not, that is, the detection of an ejected state is performed, the control unit 24 moves the recording head 1 between the photo-interrupters of the ink detection sensor 44 and the recording head 1 is moved at a predetermined speed ejecting the ink from the head having the color which corresponds to the recording head 1 so that the ejected ink can cross the optical axis (slit) of the photo-interrupter.

At this time, the ejection start position is changed every ink colors of an object from which a remaining ink amount is detected. This performs ink ejection by changing the ejection start position corresponding to the color of the ink for which the presence of ink ejection is inspected, for example, like Ly when an ink amount is inspected by ejecting yellow ink to the moving distance L from the aforementioned home position to the optical axis of the ink detection sensor 44, Lm when magenta ink is inspected, distance Lc when cyan ink is inspected and distance Lbk for black ink. Then, a variation amount of the output from a photo-interrupter is input every colors. If the variation amount is greater than a predetermined amount, it is decided that there is ink, and when the variation amount is smaller than the predetermined amount, it is decided that there is no ink. Besides, the configuration in which the ejection start position is changed every colors is effective in the configuration in which a nozzle column is inclined against the optical axis of a sensor and the configuration in which the position of the nozzle column having each color is shifted in the carriage scanning direction.

Further, the number of ejection times every nozzle at the time when ink is ejected from the recording head 1 at detection is changed every ink color of an object from which a remaining ink amount is detected. This ejects the ink by changing the number of ejection times corresponding to the color of the ink for which the presence of ink ejection is inspected, for example, like Ny times when an ink amount is inspected by ejecting yellow ink, Nm times when magenta ink is inspected, Nc times when cyan ink is inspected and from Nbk when black ink is inspected. Then, a variation amount of the output from a photo-interrupter is input every colors. If the variation amount is greater than a predetermined amount, it is decided that there is ink and if the variation amount is smaller than the predetermined amount, it is decided that there is no ink.

Furthermore, the ejection cycle in which ink is ejected from the recording head 1 at detection is changed every ink color of an object from which a remaining ink amount is detected. This ejects ink by changing the ejection cycle corresponding to the color of the ink for which the presence of ink ejection is inspected, for example, like Fy when the ink amount is inspected, Fm when magenta ink is inspected, Fc for cyan ink and Fbk for black ink. Then, a variation amount of the output from a photo-interrupter is input every colors. If the variation amount is greater than a predetermined amount, it is decided that there is ink and when the variation amount is smaller than the predetermined amount, it is decided that there is no ink.

Moreover, the travel speed of the recording head 1 at detection is changed every color of an object from which a remaining ink amount is detected. This ejects ink by changing the travel speed of the recording head 1 corresponding to the color of the ink for which the presence of ink ejection is inspected, for example, like Vy when an ink amount is inspected by ejecting the ink, Vm when magenta ink is inspected, Vc for cyan ink and Vbk for black ink. Then, a variation amount of the output from a photo-interrupter is input every colors. If the variation amount is greater than a predetermined amount, it is decided that there is ink and when the variation amount is smaller than the predetermined amount, it is decided that there is no ink.

For the aforementioned number of ejection times, ejection cycle and the travel speed of a recording head, the respective conditions may properly be combined conforming to the color of ink or the configuration may also be used in which at least one condition is changed in accordance with the color of the ink. Further, it is desirable that how each control is combined be optimally adjusted and the respective conditions be optimally adjusted in accordance with the color and density of the ink.

Figure 9:
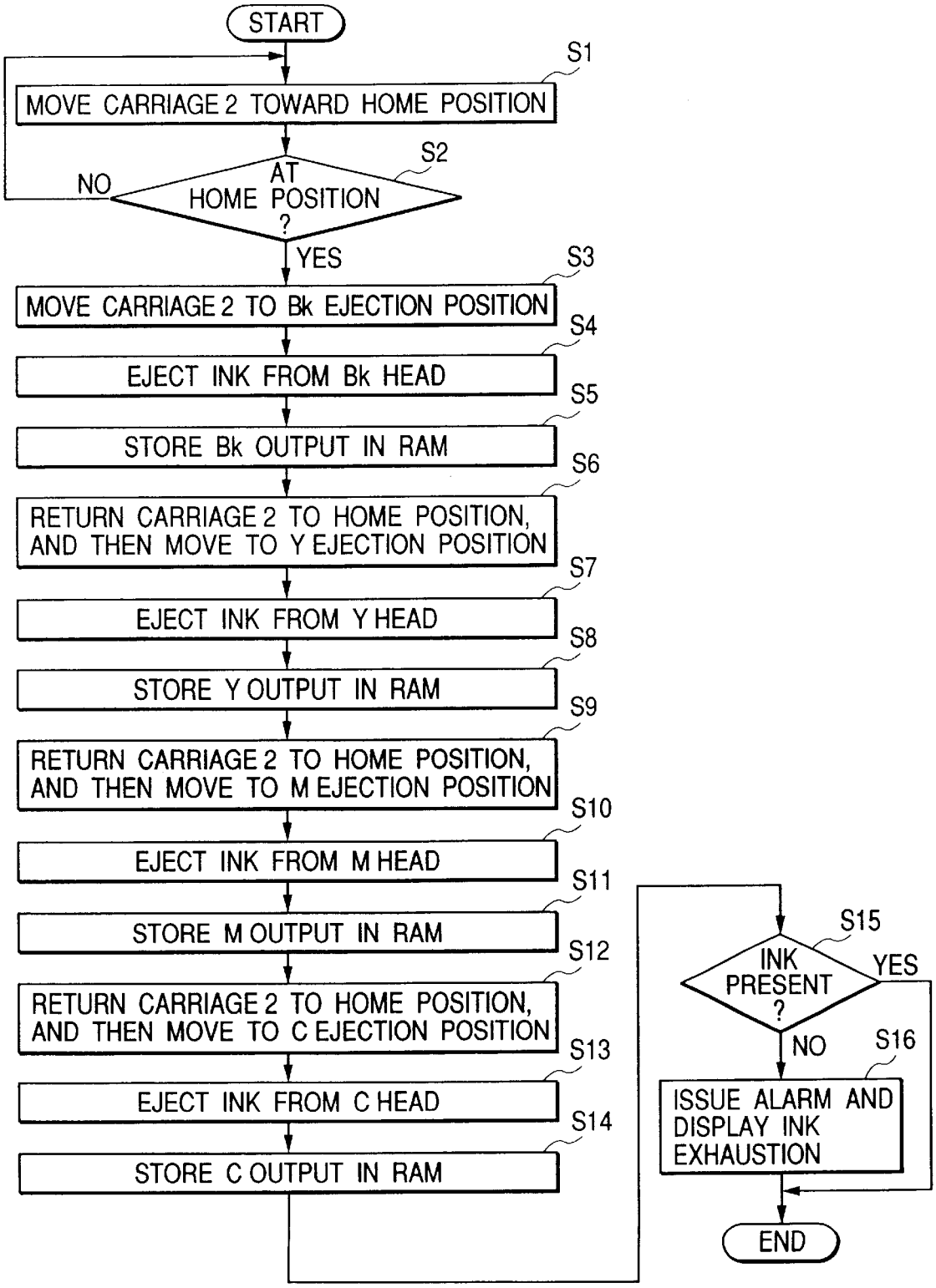
FIG. 9 is a flowchart for describing the processing in one embodiment of the present invention.

FIG. 9 is a flowchart showing the remaining ink amount detection operation in an ink jet recording apparatus according to one embodiment of the present invention, and the control program which executes this processing is stored in the ROM 26.

In the same diagram, when the detection processing using the sensor 44 is instructed, in Step S1, it is judged whether print operation is completed, and if it is completed, the carriage 2 is moved toward the home position. Besides, at this time, if the carriage 2 is in the home position, these processing of S1 and S2 are unnecessary. Then, when the carriage 2 reaches the home position, processing advances from Step S2 to Step 3, the carriage 2 is moved at speed Vbk for the purpose of detection of black ink, the black head 1*bk* is driven in Step S4 and the black ink is ejected from position Lbk, at cycle Fbk, Nbk times. Then, processing advances to Step S5 and the digital value from the A/D converter circuit 28 is stored in the RAM 27. In this embodiment, speed Vbk is about 280 mm per second, position Lbk is about 236.5 mm from the home position, ejection frequency Fbk is about 6.25 kHz and the number of ejection times Nbk is 60.

Subsequently, after the carriage 2 has returned to the home position in Step S6, movement is started toward the ink detection sensor 44 at speed Vy. Then, in Step S7, the yellow head 1*y* is driven and yellow ink is ejected from position Ly, at cycle Fy, Ny times. Then, processing advances to step S8 and the digital value from the A/D converter circuit 28 is stored in the RAM 27. In this embodiment, speed Vy is about 280 mm per second, position Ly is about 237.1 mm from the home position, ejection cycle Fy is about 10 kHz and the number of ejection times Ny is 100.

Subsequently, in Step S9, after the carriage 2 has returned to the home position, movement is started toward the ink detection sensor 44 at speed Vm. Then, in Step S10, the magenta head 1*m* is driven and magenta ink is ejected from position Lm, at cycle Fm, Nm times. Then, processing advances to Step S11 and the digital value from the A/D converter circuit 28 is stored in the RAM 27. In this embodiment, speed Vm is about 280 mm per second, position Lm is about 236.9 mm from the home position, ejection cycle Fm is about 10 kHz and the number of ejection times Nm is 100.

Subsequently, in Step S12, after the carriage 2 has returned to the home position, movement is started toward the ink detection sensor 44 at speed Vc. Then, in Step S13, the cyan head 1*c* is driven and cyan ink is ejected from position Lc, at cycle Fc, Nc times. Then, processing advances to Step S14 and the digital value from the A/D converter circuit 28 is stored in the RAM 27. In this embodiment, speed Vc is about 280 mm per second, position Lc is about 236.7 mm from the home position, ejection cycle Fc is about 10 kHz and the number of ejection times Nc is 100.

Subsequently, in Step 15, the pulse width of each color stored in the RAM 27 is read by the CPU 25. A read pulse width is compared with a predetermined amount. When the read pulse width is smaller than the predetermined amount, it is decided that there is no ink and processing advances to Step S16. An alarm is issued and the message indicating that there is no ink is displayed on an LCD 59.

On the other hand, in Step S15, when it is decided that there is ink for each color, processing ends normally.

Thus, according to this embodiment, when a remaining ink amount is detected in a recording head, the presence of ink can be decided more surely by changing the travel speed of the carriage 2 which scans the recording head according to the color characteristics of ink to be ejected or the ejection start position, the ejection cycle and the number of ejection times.

In particular, when the travel speed of a recording head was changed for the change of control every color at aforementioned detection, if the ejection cycle is equal, the number of ink droplets ejected in an area while the recording head is moving will be changed. That is, if the travel speed is delayed, the number of ink droplets ejected in the vicinity of the optical axis of a sensor is increased, and even for the ink having a color which is difficult to detect by the aforementioned sensor 44, it can be detected with good accuracy.

Further, when the ejection cycle was changed, the number of ink droplets ejected in an area while the recording head is moving will be changed, and even for the ink having a color which is difficult to detect by the aforementioned sensor 44, it can be detected with good accuracy.

From the above points, when the detection characteristics (light shielding characteristics of an optical axis) by the sensor 44 differ depending on the difference in the color of ink, the number of ink droplets ejected in a predetermined area in the vicinity of the sensor 44 is changed by changing the travel speed of a recording head and the ejection cycle at which an ink droplet is ejected. Accordingly, it can be detected that the ink droplet of each color is normally ejected and the detection result can be used for judgment of the presence of a remaining ink amount.

Further, by adjusting the ejection start position according to ink to be detected, the detection accuracy which corresponds to each color can be increased. In particular, the nozzle column installed in a recording head is inclined against the optical axis of the sensor 44, the position where the nozzle column which corresponds to each color crosses the optical axis of the sensor differs every color. In such configuration, if detection is performed in the common position for each color, it may be shifted from the optimum detection position and the detection accuracy will differ every color. Further, if the ink ejection range during carriage scanning is set wide so that detection is enabled at the common position for each color, an ink amount to be consumed wastefully will increase. Accordingly, by making the ejection start position differ according to the color of ink as described above, the detection accuracy of each ink is increased and the consumption of waste ink can be suppressed.

Furthermore, by changing the number of ink droplets to be ejected, the range from the ejection start position to the ejection end position within the carriage scanning range will be changed. Accordingly, the detection accuracy of each ink is increased and the consumption of waste ink can be suppressed in the same manner as the adjustment of the ejection start position as described above.

Besides, in the aforementioned embodiment, an example in which control differs at detection was listed in particular when black ink is detected and a color ink other than the black ink is detected. This is because the detection characteristics by the sensor 44 increase between the black ink and color ink in particular. In addition to the aforementioned embodiment, by further making control differ every color inks of yellow, magenta and cyan, the presence of ejection of ink droplets can be detected with better accuracy.

Second Embodiment

Next, a second embodiment of the present invention is described in detail.

The present invention aims at the fact that a characteristic of intercepting the axial axis of a sensor differs, and an object of the present invention is to surely be able to detect whether ink is normally ejected by changing the condition at the time when the detection is performed corresponding to this light shielding characteristic.

The configuration of an apparatus to which this embodiment applies is equal to that of the first embodiment described previously. The configuration of a facsimile machine to which an ink jet recording apparatus was applied is described quoting it as an example, and its specific description is omitted.

This embodiment relates to an ink jet recording apparatus which can perform the recording of an image by ejecting a plurality of inks having different density in the same system color, and also relates to the configuration in which whether ink is normally ejected or there is a remaining ink amount can be detected and decided regarding each of the plurality of inks having different density.

Figure 10C:
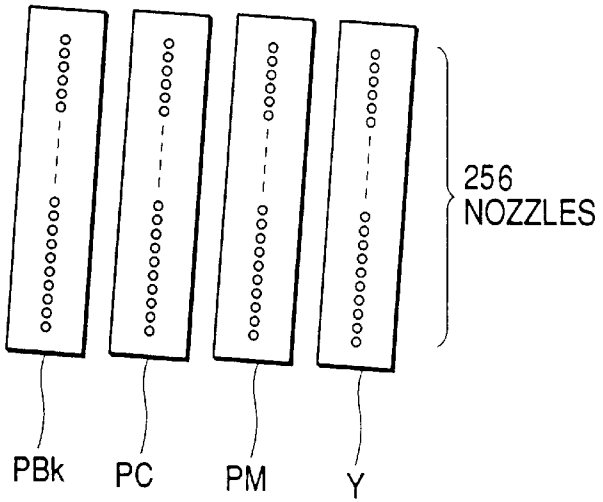
FIGS. 10A, 10B and 10C are diagrams for describing the nozzle configuration of a plurality of recording heads which are applicable to a second embodiment of the present invention.
Figure 10B:
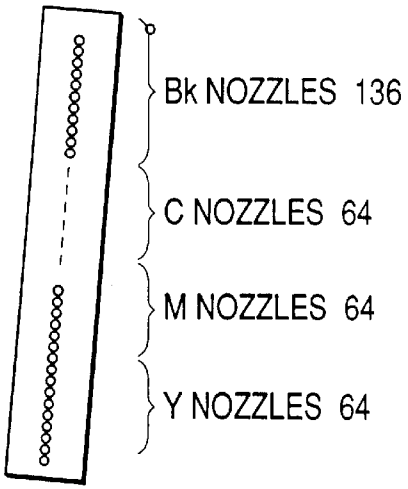
Figure 10A:
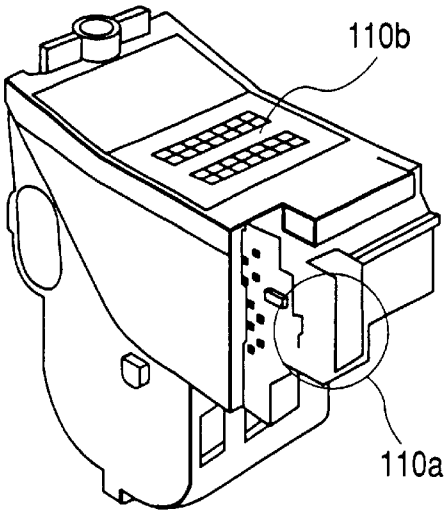

The recording head 1 used in the present invention ejects ink from an ejection port at the nozzle end by means of the pressure of film boiling which occurred in the ink by the generation of heat of an electrothermal converting element installed in a nozzle. FIG. 10A shows an appearance of the recording head 1. The recording head 1 has an ejection port surface 110*a* on which a plurality of nozzles were arranged and a contact unit 110*b* for electrically connecting a recording apparatus. An ink jet recording apparatus of this embodiment can use a color recording head 1*a* which can eject four-color inks of black, yellow, magenta and cyan and a photo color recording head 1*b* which can eject a plurality of inks whose density was adjusted to perform the recording of photo image quality so that they can be replaced. The appearance configurations of the color recording head 1*a* and the photo color recording head 1*b* do not differ, and each appearance configuration is omitted. FIG. 10B is a diagram showing a nozzle layout in the ejection port surface of the color recording head 1*a* and FIG. 10C is a diagram showing a nozzle layout in the ejection port surface of the photo color recording head 1*b*.

The nozzle column formed on the ejection port surface of the color recording head 1*a* arranges a group of nozzles which correspond to each of a plurality of colors, in one column, as shown in FIG. 10B. In this embodiment, 136 nozzles for black ink and 64 nozzles respectively which correspond to color inks of yellow, magenta and cyan are arranged in one column in accordance with the resolution of 600 DPI. Further, the photo color recording head 1*b* arranges 256 nozzles respectively which correspond to color inks of photo black, yellow, photo magenta and photo cyan in four columns and in parallel in accordance with the resolution of 600 DPI. In this case, each ink of photo black, photo magenta and photo cyan used in the photo color recording head 1*b* reduces density to about one sixth as compared with each ink of normal black, magenta and cyan. By properly using two types of recording heads of the color recording head 1*a* and the photo color recording head 1*b*, two types of printing of high-definition full color printing and photo image quality full color printing are properly used.

Besides, the ejection principle and schematic configuration of a recording head described in this embodiment are those described in the first embodiment. Further, the electric configuration of a sensor which detects ink ejection and the ejection position at the time when detection is performed are equal to the configuration described in the first embodiment with reference to FIG. 5 and FIG. 7, and their detailed description is omitted.

Further, the control configuration of an apparatus is the same as the configuration of FIG. 6 described in the first embodiment. The recording head 1 which corresponds the color recording head 1*a* and the photo color recording head 1*b* is connected to the control unit 24 via the flexible cable 7. The recording head 1 and the flexible cable 7 are connected by press-fitting mutual contacts. The flexible cable 7 includes control signal lines and image signal lines from the control unit 24 to the recording head 1. Further, by detecting the disconnection/connection between specific contact points among these contacts, the CPU 25 detects that the recording head 1 mounted on an apparatus is either the color recording head 1*a* or the photo color recording head 1*b*. Furthermore, the output of the ink detection sensor 44 is input to the control unit 24 via the A/D converter circuit 28 and the CPU 25 has the configuration in which it can analyze the ejected state of ink in accordance with the A/D converted digital value. Moreover, the control unit 24 controls the carriage motor 30 via the motor driving circuit 2*o*, the rotation of the conveying motor 22 via the motor driving circuit 21 and the rotation of the reading motor 40 via the motor driving circuit 41.

Figure 11A:
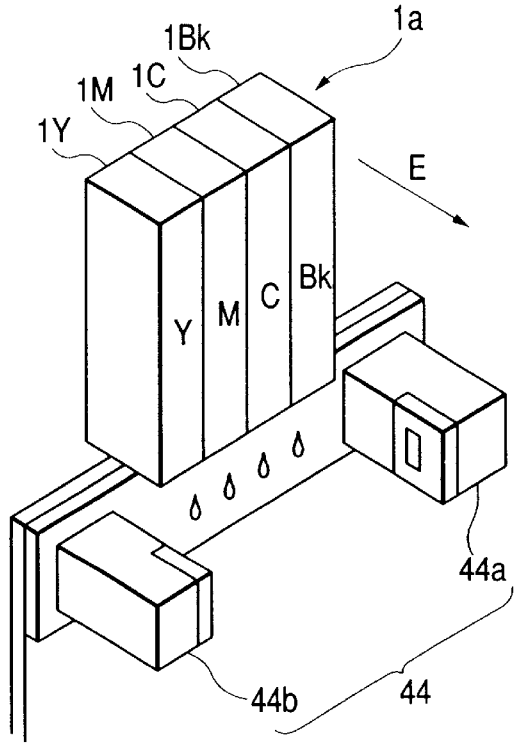
FIGS. 11A and 11B are perspective diagrams showing the position relationship between a photo-interrupter type sensor and a recording head in a second embodiment of the present invention.
Figure 11B:
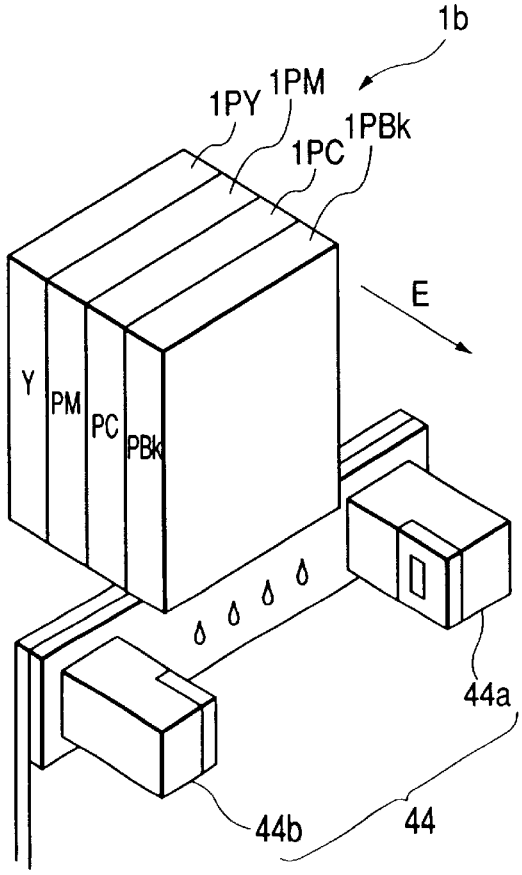

In this embodiment, the clock frequency of the reference clock 48 of FIG. 6 is about 56.5 [1/msec] in the same manner as the first embodiment. The threshold of judgment as to whether ink was ejected are 90 pulses for black ink and photo black ink and 30 pulses for inks of yellow, magenta, photo magenta, cyan and photo cyan. FIGS. 11A and 11B typically show the configuration of the recording heads 1*a* and 1*b* and the detection means 44 of this embodiment described with reference to FIG. 10B and FIG. 10C. FIG. 11A is a diagram showing the color recording head 1*a* which has the heads 1Y, 1M, 1C and 1Bk which eject color inks of Y (yellow), M (magenta), C (cyan) and Bk (black). The number of nozzles of each head is 64 for 1Y, 1M and 1C respectively and 136 for 1Bk.

Further, FIG. 11B shows the photo color recording head 1*b* which has heads 1PY, 1PM, 1PC and 1PBk which eject color inks of Y (yellow), PM (photo magenta), PC (photo cyan) and PBk (photo black). The number of nozzles of each head is 256 respectively.

Furthermore, in the examples shown in FIGS. 11A and 11B list examples in which the head which corresponds to each color was arranged, and the configuration in which each area is made to correspond to each color ink by dividing the ejection port arranged in one head into a plurality of areas.

Further, for the color recording head 1*a*, the nozzles of these heads 1Y, 1M, 1C and 1Bk are inclined by 3 degrees 35 minutes against the direction which is normal to the scanning direction E of the recording head 1*a* and arranged in one column. For the photo color recording head 1*b*, the nozzles of these heads 1PY, 1PM, 1PC and 1PBk are inclined by 3 degrees 35 minutes against the direction which is normal to the scanning direction of the recording head and arranged at intervals of about 1.5 mm in four columns and in parallel.

Furthermore, the optical axis connecting the light emitting element 44*a* and the light reception element 44*b* is arranged almost in parallel to the direction which is normal to the scanning direction E of the recording head 1 and the spacing between the light emitting element 44*a* and the light reception element 44*b* is comprised longer than the length of the nozzle column installed in the recording heads 1*a* and 1*b*. When the presence of ink ejection of the recording head is detected, the control unit 24 moves the recording head 1 between the photo-interrupters of the ink detection sensor 44 and ejects the ink from a head having the color which corresponds to the recording head 1. At the same time, the recording head 1 is moved at a predetermined speed so that the ejected ink can cross the optical axis (slit) of the photo-interrupter.

The configuration which corresponds to both the color recording head 1*a* and the photo color recording head 1*b* is described below by generically calling the h color recording head 1.

When the ejection of the ink of the recording head 1 is detected, the ejection start position in which the ink is ejected from the recording head while the recording head 1 is moving to the main scanning direction E is changed every ink color of an object to be detected. This ejects the ink by changing the ejection start position corresponding the color of the ink for which the presence of ink ejection is inspected, for example, like Ly when an ink amount is inspected by ejecting yellowing ink to distance L in which the recording head moves from the aforementioned home position to the optical axis of the ink detection sensor 44, distance Lm for the inspection of magenta ink, the distance Lc for cyan ink and the Lbk for black ink. Further, a variation amount of the output from a photo-interrupter is input every colors. If the variation amount is greater than a predetermined amount, it is decided that there is ink, and if the variation amount is smaller than the predetermined amount, it is decided that there is no ink. Besides, the configuration in which the ejection start position is changed every colors in this manner is effective in the configuration in which a nozzle column is inclined against the optical axis of a sensor and arranged and the configuration in which the position of the nozzle column having each color is shifted in the carriage scanning direction, as shown in this embodiment.

Further, similarly, the number of ejection times and ejection cycle every nozzle of the recording head 1 and the moving speed of the recording head 1 at detection are changed every ink color of the recording head type of an object from which a remaining ink amount is detected.

For the number of ejection times, ejection cycle and the moving speed of the recording head described above, the respective conditions may also be properly combined in conformity with the color and density of ink or the configuration may also be used in which at least one condition is changed in accordance with the color and density of the ink. Further, it is desirable that how each control be combined be optimally adjusted and the respective conditions be optimally adjusted in accordance with the color and density.

The processing at the time when the detection of ink ejection is performed is described in accordance with the flowchart of FIG. 9 described in the first embodiment. Besides, for the processing shown in the flowchart of FIG. 9, the ink and head described as M (magenta) in the first embodiment is re-read as PM (photo magenta) ink and head for photo magenta for the photo color recording head 1*b*. Further, the ink and color recording head described as C (cyan) are re-read as PC (photo cyan) in the same manner as above.

In the processing shown in FIG. 9, when the detection processing of an ink amount is instructed, in Step S1, it is judged whether print operation is completed, and if it is completed, the carriage 2 is moved toward the home position. Besides, in this time, if the carriage 2 is in the home position, these processing of S1 and S2 are unnecessary. Then, when the carriage 2 reaches the home position, processing advances from Step S2 to Step S3 and the carriage 2 is moved at speed Vbk for the purpose of detection of black ink. At the same time, the black head 1Bk is driven in Step S4 and the black ink is ejected from position Lbk, at cycle Fbk, Nbk times. Then, processing advances to Step S5 and the digital value from the A/D converter circuit 28 is stored in the RAM 27. In this embodiment, for the color recording head 1*a*, speed Vbk is about 280 mm per second, position Lbk is about 236.5 mm from the home position, ejection frequency Fb is about 6.25 kHz and the number of ejection times Nbk is 60. Further, when a recording head to be mounted is the photo color recording head 1*b*, for the ejection of photo black ink, speed Vbk is about 280 mm per second, position Lbk is about 238 mm from the home position, ejection frequency Fb is about 6.25 kHz and the number of ejection times Nbk is 50.

Subsequently, in Step S6, after the carriage 2 has been returned to the home position, movement is started toward the ink detection sensor 44 at speed Vy. Then, in Step S7, the yellow head 1*y* is driven and yellow ink is ejected from position Ly, at cycle Fy, Ny times. Subsequently, processing advances to Step S8 and the digital value from the A/D converter circuit 28 is stored in the RAM 27. In this embodiment, for the color recording head 1*a*, speed Vy is about 280 mm per second, position Ly is about 237.1 mm from the home position, ejection cycle Fy is about 10 kHz and the number of ejection times Ny is 100. Further, when the photo color recording head 1*b* is mounted, speed Vy at which the recording head is moved at the time when the ejection of yellow ink is detected is about 275 mm per second, position Ly is about 239.5 mm from the home position, ejection cycle Fy is about 10 kHz and the number of ejection times Ny is 50.

Subsequently, in Step S9, after the carriage 2 has been the home position, movement is started toward the ink detection sensor 44 at speed Vm. Then, in Step S10, the magenta head 1*m* is driven and magenta ink is ejected from position Lm, at cycle Fm, Nm times. Then, processing advances to Step S11 and the digital value from the A/D converter circuit 28 is stored in the RAM 27. In this embodiment, for the color recording head 1*a*, speed Vm is about 280 mm per second, position Lm is about 236.9 mm from the home position, ejection cycle Fm is about 10 kHz and the number of ejection times Nm is 100. Further, when the photo color recording head 1*b* is mounted, speed Vm at which the ejection of photo magenta ink is about 270 mm per second, position Lm is about 241 mm from the home position, ejection cycle Fm is about 10 Hz and the number of ejection times Nm is 50.

Subsequently, in Step S12, after the carriage 2 has been the home position, movement is started toward the ink detection sensor 44 at speed Vc. Then, in Step S13, the cyan head 1*c* is driven and cyan ink is ejected from position Lc, at cycle Fc, Nc times. Then, processing advances to Step S14 and the digital value from the A/D converter circuit 28 is stored in the RAM 27. In this embodiment, for the color recording head 1*a*, speed Vc is about 280 mm per second, position Lc is about 236.7 mm from the home position, ejection cycle Fc is about 10 kHz and the number of ejection times Nc is 100. Further, when the photo color recording head 1*b* is mounted, speed Vc at which the ejection of photo magenta ink is about 265 mm per second, position Lc is about 242.5 mm from the home position, ejection cycle Fc is about 10 Hz and the number of ejection times Nc is 50.

Subsequently, in Step S15, the pulse width of each color stored in the RAM 27 is read by the CPU 25. A read pulse width is compared with a predetermined amount. If the read pulse width is smaller than the predetermined amount, it is decided that there is no ink. When processing advances to Step S16 and an alarm is issued, the message indicating that there is no ink is displayed on the LCD 59.

On the other hands, in Step S15, when it is decided that there is ink for each color, processing ends abnormally.

Thus, according to this embodiment, when a remaining ink amount is detected, the decision of the presence of ink is enabled more surely by changing the moving speed of the carriage 2 by which a recording head is moved and scanned or the ejection start position, ejection cycle and the number of ejection times according to the characteristics of the color and density of the ink to be ejected. Further, in this embodiment, the decision of the presence of ink is enabled more surely by making detection control differ according to the type of the recording head mounted on the recording apparatus. Thus, the present invention aims at the fact that a characteristic of intercepting the optical axis of a photo-interrupter differs depending on the color and density of the ink to be detected, and whether ink is normally ejected can surely be detected by the photo-interrupter by changing detection conditions corresponding to this light shielding characteristic.

Besides, the aforementioned second embodiment was described quoting an example in which detection control was made to differ in particular when black ink is detected and another color ink is detected and an in which detection control was made to differ when ink of normal density is detected and photo ink whose density was adjusted is detected. This is because the detection characteristic (light shielding characteristic which shields the optical axis a photo-interrupter) by the sensor 44 increases in particular between black and color inks and between inks of different density). In addition to the aforementioned embodiment, the presence of ejection of an ink droplet can be detected with better accuracy by making control differ every color inks of yellow, magenta and cyan.

Other Embodiments

The above embodiments were described quoting the configuration of a recording apparatus which performs recording by mounting a cartridge type recording head in which an ink tank was installed in the recording head itself in one body as an example. The present invention is not restricted to such configuration and may use a chip type recording head in which electric connection with an apparatus main unit and the supply of ink from the apparatus is enabled by being mounted on the apparatus main unit and which can be replaced.

Further, recording modes of a recording apparatus may include not only the recording mode of a primary color such as black but also the mode in which a recording head is comprised in one body or a plurality of recording heads are combined. Otherwise, a device comprising at least one of double colors having different colors or full colors based on a color mixture can be used.

In addition, modes of a recording apparatus according to the present invention may include one which is installed in one body or another body as an image output terminal for information processing equipment such as computers, a copying device combined with readers and a facsimile machine having the send and receive function.

Further, the present invention may apply to a system consisting of a plurality of equipment and also apply to a device consisting of one piece of equipment. Furthermore, needless to say, the present invention can also apply to even the case where processing is executed by supplying the program to a system or device. In this case, a storage medium in which the program according to the present invention was stored comprises the present invention. Then, by reading the program from the storage medium to a system or device, the system or device operates in a predetermined manner. In this embodiment, a threshold of the presence of ink was fixed. However, for example, the threshold may be made variable, such as it is set to a fixed rate of the output at remaining ink amount detection performed when a recording unit is replaced.

As described above, according to the present invention, to judge a drop of an ink amount when ink is ejected, there is an effect that the reliability of a decision result can be improved by changing detection control corresponding to a light shielding characteristic which differs depending on the color and density of the ink to be inspected.

What is claimed is:

1. An ink jet recording apparatus which performs recording on a recording medium by ejecting inks of a plurality of different colors by the use of an ink jet head for ejecting the inks, said ink jet recording apparatus comprising:

moving means for moving the ink jet head within a moving area to the recording medium, detecting means, installed externally from the ink jet head at a predetermined position within the moving area of the ink jet head by the moving means, for detecting ink droplets ejected from the ink jet head and outputting a detection signal in accordance with a detection result, ink ejecting means for moving the ink jet head by the moving means and ejecting the inks from the ink jet head within a predetermined area including the predetermined position, deciding means for deciding the presence of ink ejection by the ink ejecting means on the basis of a detection signal output from the detecting means, and control means for changing at least one condition of the ink ejection cycle by the ink ejecting means, the moving speed of the ink jet head by the moving means and the number of the inks ejected within the predetermined area by the ink ejecting means, in accordance with the colors of the inks.

2. The ink jet recording apparatus according to claim 1, wherein the detecting means comprises a light emitting element and a light reception element, detects the ink droplets ejected from the ink jet head between the light emitting element and the light reception element, and outputs a detection signal in accordance with a change quantity of the light which reaches the light reception element.

3. The ink jet recording apparatus according to claim 1, wherein the ink jet head has a plurality of nozzle series corresponding to the inks of the plurality of colors, respectively, and which further has ejecting position control means for controlling an ink ejecting start position in accordance with the color of the ink ejected by ink ejecting means.

4. The ink jet recording apparatus according to claim 1, wherein the ink jet head has a plurality of ejection energy generating elements for ejecting the inks, and the control means controls the ink ejection cycle by changing a driving cycle of the ejection energy generating elements.

5. The ink jet recording apparatus according to claim 1, wherein the speed control means controls a driving frequency of the moving means to control the moving speed of the ink jet head.

6. The ink jet recording apparatus according to claim 1, wherein the ink jet head has a plurality of ejection energy generating elements for ejecting the inks, and the control means controls the number of the ejected inks by changing a driving number of the ejection energy generating elements.

7. An ink detection method in an ink jet recording apparatus which performs recording on a recording medium by ejecting inks of a plurality of different colors by the use of an ink jet head for ejecting the inks, said ink detection method comprising:

a moving step of moving the ink jet head to detecting means, installed externally from the ink jet head at a predetermined position within an area to which the ink jet head is moved, for detecting ink droplets ejected from the ink jet head and outputting a detection signal in accordance with a detection result, an ink ejecting step of ejecting the inks from the ink jet head when the ink jet head is located in a predetermined area including the predetermined position during the moving of the ink jet head in the moving step, and a deciding step of deciding the presence of ink ejection on the basis of the detection signal output by the detecting means, at least one condition of the ink ejection cycle in the ink ejecting step, the moving speed of the ink jet head in the moving step and the number of the inks ejected within the predetermined area in the ink ejecting step being changed, in accordance with the colors of the inks.

8. The ink detection method according to claim 7, wherein the detecting means comprises a light emitting element and a light reception element, and outputs a different detection signal in accordance with whether or not the ink droplets pass through an optical axis between the light emitting element and the light reception element, and the ink ejecting step ejects the ink to the predetermined area including the optical axis.

9. The ink detection method according to claim 7, wherein the ink jet head has a plurality of nozzle series corresponding to the inks of the plurality of colors, respectively, and which further has ejecting position control means for controlling an ink ejecting start cycle in accordance with the color of the ink ejected by ink ejecting step.

10. The ink detection method according to claim 7, wherein the ink jet head has a plurality of ejection energy generating elements for ejecting the inks, and the control of the ink ejection cycle is performed by changing a driving cycle of the ejection energy generating elements.

11. The ink detection method according to claim 7, wherein the movement of the ink jet head is performed by the drive of a motor, and the change of the moving speed of the ink jet head is performed by the control of the drive of the motor.

12. The ink detection method according to claim 7, wherein the ink jet head has a plurality of ejection energy generating elements for ejecting the inks, and the control of the number of the ejected inks is performed by changing a driving number of the ejection energy generating elements.

13. An ink jet recording apparatus which performs recording on a recording medium by ejecting a plurality of inks having different light shielding characteristics, said ink jet recording apparatus comprising:

a carriage equipped with an ink jet head for ejecting the inks;

main scanning means for scanning the ink jet head mounted on the carriage by scanning the carriage to the recording medium along a main scanning direction;

detecting means which is located externally from the ink jet head at a predetermined position within the scanning area of the ink jet head scanned by the main scanning means and which comprises light emitting means for emitting light in a direction different from the main scanning direction and light reception means for receiving the light emitted by the light emitting means and which outputs a signal according to whether or not an optical axis formed between the light emitting means and the light reception means is intercepted by ink droplets ejected from the ink jet head;

ejection control means for scanning the ink jet head by the scanning means and for ejecting the ink from the ink jet head within a predetermined area including the optical axis of the detecting means;

deciding means for deciding the presence of ink ejection by the ejection control means on the basis of a detection signal output from the detecting means; and control means for changing at least one condition of the ejection cycle of the ink ejected by the ejection control means, the scanning speed of the ink jet head by the main scanning means, a position of the start of the ink ejection by the ejection control means and the number of inks ejected within the predetermined area by the ejection control means, in accordance with the light shielding.

14. The ink jet recording apparatus according to claim 13, wherein the plurality of inks have a plurality of colors, and the control means changes at least the one condition in accordance with light shielding characteristics based on the different colors of the inks.

15. The ink jet recording apparatus according to claim 13, wherein the plurality of inks have different concentrations, and the control means changes at least the one condition in accordance with light shielding characteristics based on the different concentrations of the inks.

16. The ink jet recording apparatus according to claim 13, wherein the carriage permits exchangeably carrying the plurality of ink jet heads for the different inks to be ejected, and the control means changes at least the one condition in accordance with differences of the colors of inks to be detected and the concentrations of the inks.

17. The ink jet recording apparatus according to any one of claims 13 to 16, wherein the ink jet head has a plurality of heating elements for generating heat energy, and bubbles are generated in the ink by the drive of the heating elements to eject the ink.

18. An ink detection method in an ink jet recording apparatus which moves an ink jet head for ejecting ink to a recording medium and which performs recording on the recording medium by ejecting a plurality of inks different in light shielding characteristics, said ink detection method comprising:

a moving step of moving the ink jet head to detecting means which is located externally from the ink jet head at a predetermined position within an area to which the ink jet head is moved and which comprises light emitting means for emitting light and light reception means for receiving the light and which outputs a signal according to whether or not an optical axis formed between the light emitting means and the light reception means is intercepted by ink droplets ejected from the ink jet head;

an ink ejecting step of ejecting the ink from the ink jet head when the ink jet head is located within a predetermined area including the predetermined position during the moving of the ink jet head in the moving step; and a deciding step of deciding the presence of ink ejection on the basis of the detection signal output by the detecting means, wherein at least one condition of the ejection cycle of the ink ejected in the ink ejecting step, the travel speed of the ink jet head, the position of the start of the ink ejection in the ink ejecting step and the number of the inks ejected within the predetermined area in the ink ejecting step are changed in accordance with the light shielding characteristics of the ink.

19. The ink detection method according to claim 18, wherein the ink jet recording apparatus ejects the inks of the plurality of colors to perform the recording, and changes at least the one condition in accordance with light shielding characteristics based on the different colors of the inks.

20. The ink detection method according to claim 18, wherein the ink jet recording apparatus ejects the plurality of inks of different concentrations to perform the recording, and changes at least the one condition in accordance with light shielding characteristics based on the different concentrations of the inks.

21. The ink detection method according to claim 18, wherein the ink jet recording apparatus permits exchangeably carrying the plurality of ink jet heads for the different inks to be ejected, and changes at least the one condition in accordance with detection characteristics based on differences of the colors of inks to be detected and the concentrations of the inks.

* * * * *